United States Patent [19]

Kulesza et al.

[11] 4,183,533

[45] Jan. 15, 1980

[54] GAME WITH PIVOTING PROJECTOR AND TARGET COMPARTMENTS

[75] Inventors: Ralph J. Kulesza, Chicago; Joseph M. Burck, Glenview; Horst-Dieter Herbstler, Bolingbrook, all of Ill.

[73] Assignee: Marvin Glass & Associates, Chicago, Ill.

[21] Appl. No.: 855,009

[22] Filed: Nov. 25, 1977

[51] Int. Cl.[2] ..... A63B 67/06

[52] U.S. Cl. ..... 273/101; 124/36; 124/17; 273/129 HA;105 R

[58] Field of Search ..... 273/101, 105 R, 126 R, 273/95 C, 95 D, 95 R, 129 HA, 118 R, 119 R, 123 R; 124/16, 17

[56] References Cited

U.S. PATENT DOCUMENTS

| | | | |
|---|---|---|---|
| 284,880 | 9/1883 | Meyer | 273/123 R |
| 417,262 | 12/1889 | Mecabe | 273/119 R |
| 497,307 | 5/1893 | Chipman | 273/119 R |
| 1,163,102 | 12/1915 | Morgan | 273/119 R |
| 1,539,648 | 5/1925 | Chester et al. | 273/101 |
| 1,645,370 | 10/1927 | Callison | 273/101 |
| 1,942,476 | 1/1934 | Harris | 273/119 R |
| 2,334,332 | 11/1943 | Johnson | 124/17 |
| 2,805,657 | 9/1957 | Shaffer | 124/16 |
| 2,827,034 | 3/1958 | Rothe | 273/101 |
| 4,085,540 | 4/1978 | Jernstrom et al. | 273/101 |

FOREIGN PATENT DOCUMENTS

| | | | |
|---|---|---|---|
| 614 | of 1908 | United Kingdom | 273/123 R |
| 29116 | of 1910 | United Kingdom | 273/95 R |

*Primary Examiner*—Richard C. Pinkham
*Assistant Examiner*—Lawrence E. Anderson
*Attorney, Agent, or Firm*—Mason, Kolehmainen, Rathburn & Wyss

[57] ABSTRACT

A novel amusement apparatus or target game includes a target for receiving projectiles aimed and fired from a mobile firing device. The target includes a plurality of separate, projectile retaining compartments which are open at the front and each compartment has a selected scoring value for projectiles that are accurately fired and retained therein. The mobile firing device is manually aimed and fired to forcefully propel the projectiles towards selected compartments of the target. The firing device includes a body, preferably in the form of an animal which is supported in upstanding position on a suitable playing surface and a firing head is pivotally mounted on the body and is biased for moving an outer end portion or nose to strike and fire a projectile toward the target. A trigger is provided for releasing the biasing means to fire the projectile, and preferably, the firing head is in the shape of an animal head, such as a bull, with a pair of horns and the bull's nose is formed with a recess adapted to accommodate and fire the projectiles which are positioned on a support system aimed generally towards the target.

3 Claims, 4 Drawing Figures

GAME WITH PIVOTING PROJECTOR AND TARGET COMPARTMENTS

BACKGROUND OF THE INVENTION

1. Field of the Invention

The present invention relates to amusement devices and more particularly relates to target game amusement devices having a mobile firing unit adapted to fire projectiles at a target having a plurality of separate compartments open at the front to receive and contain the projectiles that are accurately aimed and fired.

2. Description of the Prior Art

A great many target games and similar amusement devices have been provided over the years and these devices include a wide variety of different types of targets and projectile firing devices for shooting at the target. A wide variety of guns, cannons, rockets and other trigger release mechanisms have been developed and a wide variety of different types of target structures and scoring devices have been provided to set forth different value scores, generally based on the difficulty of aiming and firing the projectiles to hit a selected target structure.

It is an object of the present invention to provide a new and improved amusement apparatus and more particularly a target game device suitable for use by children and adults.

Another object of the present invention is to provide a novel target game device wherein the target structure includes a plurality of separate, projectile retaining compartments which are open at the front in order to receive and score accurately aimed and fired missiles or projectiles.

Another object of the present invention is to provide a target game device including a mobile, manually manipulated firing device which includes a body and a firing head pivotally mounted on the body and biased to move an outer portion or nose to engage and fire a projectile towards the target when a trigger is released.

Another object of the present invention is to provide a target game device having a mobile firing device as described which resembles an animal such as a bull.

Yet another object of the invention is to provide a new and improved target game device including a target structure and mobile firing unit of the character described and including means for returning misfired or misaimed projectiles back into a ready position wherein the projectiles may again be fired at the target.

Another object of the present invention is to provide a new and improved target game device of the character described which is economical to produce, and fun to play with and which provides a competitive game requiring manual dexterity and skill to play.

Yet another object of the present invention is to provide a new and improved target game device which players may use in competition against one another with the object of achieving the highest score based on the accuracy of aiming and firing projectiles at a target.

SUMMARY OF THE INVENTION

These and other objects and advantages of the present invention are accomplished in an illustrated embodiment comprising a target game device or amusement apparatus having a target structure for receiving projectiles aimed and fired by a mobile firing device. The target includes a plurality of separate, projectile retaining compartments which are open at the front to receive any projectiles that are accurately aimed and fired toward the target. The mobile firing device includes a body structure adapted to be self-supporting on a playing surface and a firing head is pivotally mounted on the body and has an outer nose portion adapted to forcefully engage and propel a projectile towards the target. The firing head is biased to rapidly propel the projectiles toward the target and biasing means is settable after it has been released by a trigger to fire a shot toward the target. Preferably, the firing device is fashioned in the form of an animal such as a "bull" and the target structure is generally in the form of an arcade or shooting gallery. The game apparatus includes a chute for supporting projectiles in a ready position to be fired toward the target compartment and different score values are assigned to the different compartments of the targets. Cards or coupons representing these values may be provided and are passed out to the players during the game for successfully aiming and firing projectiles into the respective scoring compartments of the target.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
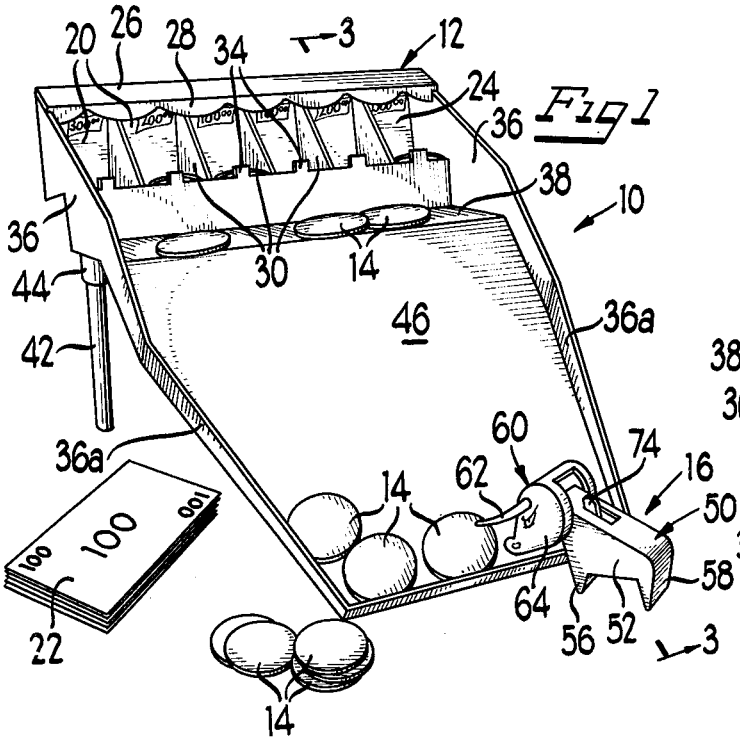
FIG. 1 is a front elevational, perspective view of a new and improved amusement apparatus or target game device constructed in accordance with the features of the present invention.
Figure 2:
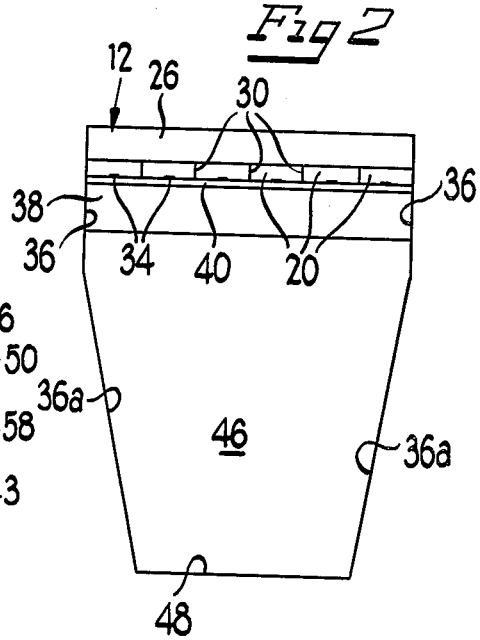
FIG. 2 is a top plan view of the target device of the invention and the associated projectile returning and supporting structure thereof.

Referring now more particularly to the drawings, therein is illustrated a new and improved amusement apparatus or target game device constructed in accordance with the features of the present invention and referred to generally by the reference numeral 10. The target game type amusement apparatus includes a target structure 12 adapted to receive projectiles 14 in the form of circular disks or the like which are aimed and fired by a mobile, manually position firing device 16. Target structure and firing device are adapted to be supported from the floor or other playing surface 18 and the firing device is designed to be self-supporting in an upstanding position on the playing surface as shown with the target structure 12 being similarly supported with target compartments at a higher level, as more fully described hereinafter.

In accordance with the present invention, the target structure 12 includes a plurality of individual, separate projectile retaining compartments 20 arranged in a horizontal, elevated row and each having an open front for receiving any projectiles which are accurately aimed and fired by the firing device 16. As illustrated in FIG. 1, each compartment is provided with an indication of a target value such as $300.00 for the outermost compartments, $200.00 for the next inwardly spaced compartments and $100.00 for the innermost centrally disposed compartments. In addition, a plurality of cards 22 having dollar values printed on the faces thereof corresponding to those of the respective compartments 20, may be provided to be handed out to the players after a projectile or disk 14 is successfully aimed and fired into a target compartment of a selected value.

Preferably, the target structure 12 is formed of integrally molded, lightweight plastic material and the target compartments 20 are aligned in a common, horizontal, elevated row in side by side relation as shown in FIG. 1. The compartments have a common backwall 24 and on the forward faces, the target dollar values are indicated as shown in FIG. 1. The compartments 20 include a common forwardly and downwardly sloping top wall 26 with a downwardly depending common upper front wall 28 at the forward edge thereof having a scalloped lower edge provided for an interesting appearance. The individual target compartments are separated from each other by means of vertical, divider walls 30 of generally trapizodal shape as shown in FIG. 3, and the forward edges of these divider walls may serve to deflect or rebound any inaccurately aimed projectiles that are fired towards the target structure.

Figure 3:
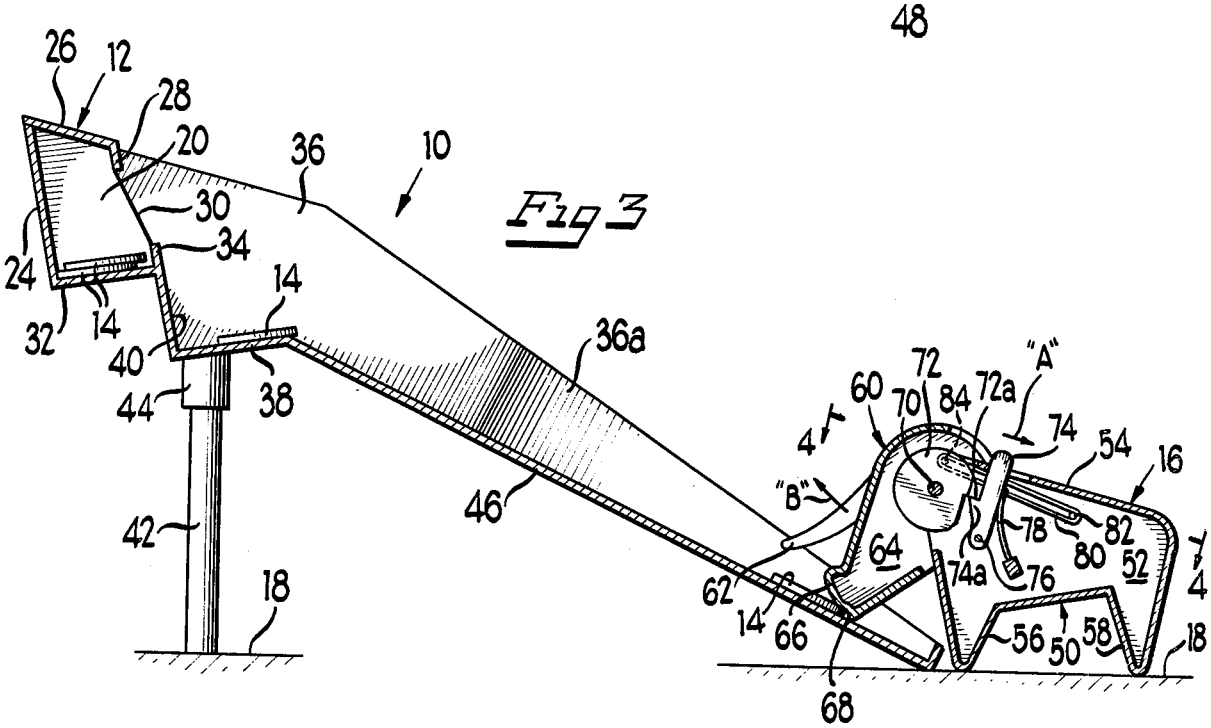
FIG. 3 is a vertical cross-sectional view taken substantially along lines 3—3 of FIG. 1.
Figure 4:
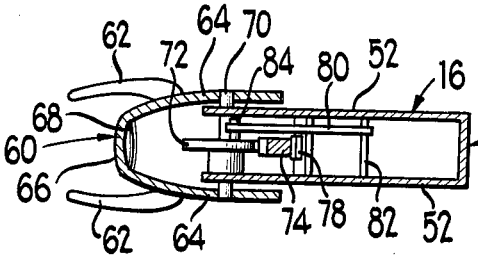
FIG. 4 is a fragmentary, cross-sectional view taken substantially along lines 4—4 of FIG. 3 illustrating the internal structure of the mobile firing device of the amusement apparatus.

The compartments 20 are provided with a common bottom wall 32 which slopes downwardly and rearwardly as illustrated in FIG. 3, and thus helps to retain the disks 14 that pass into the interior of the respective target compartments as they are accurately aimed and fired. Each compartment is also provided with a short, narrow upstanding lower front wall or retaining tab 34 at the center of the compartment and these tabs are useful in aligning or aiming the firing device 16 to shoot a disk 14 accurately into a particular selected compartment. As illustrated, the target structure 12 includes six individual target compartments 20 and the outer compartments have a greater dollar value than the inner compartments because of the greater difficulty in aiming projectiles into these compartments and also because of the possibility that improperly aimed projectiles will bounce or rebound laterally outwardly away from the target structure.

The target structure 12 is provided with a pair of vertical, outer side walls 36, which walls extend and slope downwardly and forwardly from the outside individual compartments 20 as illustrated. The side walls include inwardly divergent lower end portions **36*a*** which aid in directing and returning or rebounding the disks towards the center of the structure.

At a level below the row of open front, individual target compartments 20, there is provided a shelf structure 38 which sloped downwardly and rearwardly of the firing device and the shelf is thus sloped in order to retain at least some of the disks 14 which may not be retained in the target compartments. The shelf 38 is integrally connected with the forward edges of the bottom wall of the target compartments 20 by an upstanding back wall 40 which provides a rebound or back board surface for the disks 14 which are not fired at a high enough angle to enter the opening in the front of the respective target compartments 20.

The target structure is maintained at an elevated position above the playing surface 18 by means of a pair of posts 42 which extend upwardly into cylindrical bosses 44 provided on the underside of the holding shelf 38 as shown in FIGS. 1 and 3. Along the forward edge, the shelf is integrally connected with a downwardly and forwardly sloping bottom wall 46 having its lower forward edge supported and resting on the playing surface 18 as illustrated in FIG. 3. As upstanding lip 48 is provided along this lower edge in order to retain the disks 14 on the sloping surface of the wall in a ready position to be fired towards the target compartments by the firing device 16.

The projectile firing device or bull 16 is also formed of molded plastic material and includes a hollow body portion 50 having a pair of opposite side walls 52, a back 54, and a pair of forward and rearward leg structures 56 and 58. At the forward end of the hollow body, the bull is provided with a pivotally mounted head structure 60 having a profile and a decorative outer surface designed to resemble the head of a bull with horns 62 and a pair of opposite facial side members 64 which are integrally joined adjacent an outer end portion forming a shaped bull's nose 66. The nose has an arcuate recess or slot 68 which is provided to accommodate and fit the rounded edge of a projectile or disk 14.

The bull's head structure is mounted on an axle pin 70 of which extends between sides 64 of the head and is supported in the side walls 52 of the body structure 50. A generally circular catch member 72 is mounted on the axle between the sides of the body and the catch member is formed with a radial notch or recess **72*a* in the outer circumference forming a stop surface to retain and engage a pawl portion 74*a* on the side of a trigger 74 which is pivotally mounted on an axle pin 76 also extending between opposite sides 52 of the body of the bull. The trigger pawl is biased into interlocking holding engagement with the notch 72*a* of the catch element 72 by means of a leaf spring 78. The upper end portion of the trigger extends upwardly through a slot in the back wall 54 of the bull's body. By movement of the upper end of the trigger towards the rear of the body as indicated by the arrow "A" (FIG. 3), the pawl 74*a* of the trigger is moved out of engagement with the notch 72*a* in the disk catch element 72, and when this occurs, the element is free to rotate and drive the nose portion 66 of the bull's head to fire a projectile or disk as illustrated by the arrow "B" (FIG. 3). A biasing force for rotating the bull's head 60 is provided by means of a rubber band 80 which is replaceable and which has one end secured to a cross pin 82 between the sides 52 of the bull's body and an opposite end connected to an eccentric pin 84 on the catch disk 72. Once the trigger 74 is pressed to the rear as shown by the arrow "A" thereby releasing the engagement between the trigger pawl 74*a* and the stop surface notch 72*a* of the catch 72, the catch is rotated rapidly by the rubber band 80 to drive the bull's head 60 in a clockwise direction (as indicated by the arrow "B") and an aligned disk 14 positioned in supported position on the bottom wall 46 is fired or propelled rapidly upwardly towards the target structure compartments 20. Proper alignment of the bull's head and body with each disk in ready position provides a good chance that the disk will be propelled into the interior of one of the respective compartments 20 that it is aimed at. After a projectile has been fired, the bull is cocked or reset for the next shot by manually rotating the bull's head 60 in a counterclockwise direction until the trigger pawl 74*a* again engages an edge of the notch 72*a* of the catch element 72. As the bull's head is rotated, tension is increased on the rubber band 80** in readiness for the next release to provide a firing stroke as described.

Although the present invention has been described with reference to a single illustrated embodiment thereof it should be understood that numerous other modifications and embodiments can be devised by those skilled in the art that will fall within the spirit and scope of the principles of this invention.

What is claimed as new and desired to be secured by Letters Patent of the United States is:

1. An amusement apparatus, comprising:

target means for receiving projectiles aimed and fired thereat, said target means including a plurality of separate projectile retaining compartments open at the front, each compartment having a selected scoring value for projectiles fired and retained therein, wherein said compartments are aligned in a horizontal row in side-by-side relation and at least one compartment includes a bottom wall sloping downwardly away from said firing means and an upstanding back wall along a back edge of said bottom wall for retaining projectiles thereon, at least one of said compartments including a short upstanding lower front wall along a front edge of said bottom wall for retaining projectiles in said compartments, at least one of said compartments including a top wall and a depending upper front wall along a front edge thereof, said top wall sloping downwardly toward said front wall from an upper edge of said back wall, said compartment being open at the front between said upper and lower front walls for receiving projectiles;

manually operable mobile firing means for forcefully propelling said projectiles toward selected compartments of said target means, said firing means including a body adapted to be supported in an upstanding position on a playing surface, a firing head pivotally mounted on said body, biasing means for moving an outer portion of said firing head to engage and fire a selected projectile toward said target means, and a trigger for releasing said biasing means to fire a projectile; and means for maintaining said target means at an elevated level above said playing surface.

2. An amusement apparatus, comprising:

target means for receiving projectiles aimed and fired thereat, said target means including a plurality of separate projectile retaining compartments open at the front, each compartment having a selected scoring value for projectiles fired and retained therein;

mobile firing means manually aimed and fired to forcefully propel said projectiles toward selected compartments of said target means, said firing means including a body adapted to be supported in an upstanding position on a playing surface, a firing head pivotally mounted on said body, biasing means for moving the outer portion of said firing head to engage and fire selected projectiles toward said target means, and a trigger for releasing said biasing means to fire the projectiles;

means for maintaining said target means at an elevated level above said playing surface;

a projectile retaining shelf at a level below said target means and above said playing surface for retaining projectiles fired at the target means and not retained in said compartments, said shelf sloping downwardly away from said firing means;

an upstanding back wall along a back edge of said shelf extending upwardly between said shelf and said target means for retaining projectiles resting on said shelf and returning projectiles striking said back wall toward said firing means;

projectile support means for retaining a projectile in ready position to be fired toward said target means by said firing means; and a guide tray sloping downwardly of said shelf toward said support means for guiding projectiles into said ready position, wherein the support means includes a lower end portion of said tray.

3. An amusement apparatus, comprising:

target means for receiving projectiles aimed and fired thereat, said target means including a plurality of separate projectile retaining compartments open at the front, each compartment having a selected scoring value for projectiles fired and retained therein; and mobile firing means manually aimed and fired to forcefully propel said projectiles toward selected compartments of said target means; said firing means including a body adapted to be supported in upstanding position on a playing surface, a firing head pivotally mounted on said body, biasing means for moving an outer portion of said firing head to engage and fire a selected projectile toward said target means, and a trigger for releasing said biasing means to fire a projectile, said firing head being manually rotatable between a released position and a cocked position wherein said biasing means is restrained by said trigger until the trigger is manually operated to fire a projectile, and said firing head is shaped like the head of an animal and includes a groove on the nose thereof for engagement with said projectiles when propelling the same toward said target means.

* * * * *